US005479178A

United States Patent [19]

Ha

[11] Patent Number: 5,479,178

[45] Date of Patent: Dec. 26, 1995

[54] PORTABLE RADIO ANTENNA

[75] Inventor: Dong-In Ha, Seoul, Rep. of Korea

[73] Assignee: SamSung Electronics Co., Ltd., Khungki-do, Rep. of Korea

[21] Appl. No.: 176,455

[22] Filed: Dec. 30, 1993

[51] Int. Cl.[6] ..... H01Q 1/24

[52] U.S. Cl. ..... 343/702; 343/895; 343/900

[58] Field of Search ..... 343/702, 895, 343/900, 901; H01Q 1/10, 1/24

[56] References Cited

U.S. PATENT DOCUMENTS

| | | | |
|---|---|---|---|
| 3,803,627 | 4/1974 | Schuscheng . | |
| 4,121,218 | 10/1978 | Irwin et al. . | |
| 4,665,406 | 5/1987 | Takizawa et al. . | |
| 4,725,845 | 2/1988 | Phillips . | |
| 4,760,401 | 7/1988 | Imazeki | 343/702 |
| 4,868,576 | 9/1989 | Johnson, Jr. . | |
| 5,025,263 | 6/1991 | Okamoto et al. | 343/715 |
| 5,204,687 | 4/1993 | Elliott et al. . | |
| 5,245,350 | 9/1993 | Sroka . | |
| 5,258,772 | 11/1993 | Inanaga et al. . | |
| 5,262,792 | 11/1993 | Egashira . | |
| 5,317,325 | 5/1994 | Bottomley | 343/702 |

FOREIGN PATENT DOCUMENTS

| | | | |
|---|---|---|---|
| 3245603 | 11/1991 | Japan | 343/702 |
| 4314201 | 11/1992 | Japan | H01Q 1/24 |

*Primary Examiner*—Donald T. Hajec
*Assistant Examiner*—Tho Phan
*Attorney, Agent, or Firm*—Robert E. Bushnell

[57] ABSTRACT

An extendable and retractable antenna installed on a body housing of a portable radio apparatus includes a helical antenna having an antenna cap protruding from a top portion of the body housing, a helical winding disposed within the antenna cap, a rod antenna extending through the antenna cap, and a feeder disposed at a bottom portion of the helical antenna. The helical antenna is operated when the antenna is retracted. The rod antenna is insulated from the helical antenna when retracted, and passes through the helical antenna to protrude from the body housing when extended. The feeder operates the rod antenna when the rod antenna is extended and operates the helical antenna when the rod antenna is retracted.

21 Claims, 7 Drawing Sheets

P1 = 45.77Ω - J6.033Ω
AT 860.5 MHz

PORTABLE RADIO ANTENNA

CROSS REFERENCE TO RELATED APPLICATIONS

This application makes reference to and claims all benefits arising under 35 U.S.C. §119 arising from the earlier filing of an application in the Ministry of Industry and Trade of the Republic of Korea on 21 May 1993 duly assigned Ser. No. 8786/1993.

BACKGROUND OF THE INVENTION

The present invention relates to portable radio antennas, and more particularly to a process and a portable radio antenna for transmitting and receiving radio frequency signals in portable radio sets.

Generally, an antenna for use in a portable radio is constructed as a unitary structure, and is separately operated as a helical antenna or a rod antenna when the antenna is retracted or extended, respectively.

A conventional antenna, such as that disclosed in U.S. Pat. No. 4,868,576 entitled *Extendable Antenna or Portable Cellular Telephones with Ground Radiator* issued to Johnson, includes a helical coil and a half-wavelength radiator antenna. The radiator antenna is positioned on a top portion of a housing and includes two detents which engage tangs of an antenna housing when retracted and extended. The tangs snap into the detents, thereby providing the operator with tactile feedback indicating whether the antenna is fully retracted or extended. The radiator antenna slides into and out of the antenna housing, through the helical coil. The antenna also includes a protective top end cap, a top portion with the detent, a middle portion with a coil, a bottom portion with the detent and a bottom end cap. The radiator antenna is comprised of a flexible plastic material, such as "Delryn", with the mid-portion coil comprised of silver-plated beryllium-copper wire having a diameter of 13 mils (13/1000 inches).

When the radiator antenna is retracted, the unit is operated as a helical antenna. When extended, the extendable half-wavelength radiator antenna is capacitively coupled to the helical antenna. In order to capacitively connect the helical antenna to the radiator however, the length of the radiator must be extended. Consequently, the length of the radiator antenna becomes unnecessarily long. Also, since the center portion of the radiator antenna is comprised of conductive helical winding, the diameter of the radiator antenna is unaesthetically large.

One recent effort to overcome these disadvantages of Johnson '576 is found in the antenna described in Japanese Patent Provisional Publication No. 3-245603. This antenna includes a stainless wire rod antenna and a helical antenna positioned on a top portion of an antenna housing. A first feeder contains a housing connector positioned on a top portion of the housing; the first feeder is coupled to a stopper and to a metal ring connected to the housing connector. The metal ring is connected to a circuit board. When the antenna is extended, the stopper is connected to the housing connector. When the antenna is retracted, a second feeder coupled to the circuit board is connected to the stopper. This structure attempts to create an infinite antenna impedance.

Hence, when the antenna is extended, since the stopper is connected to the first feeder, the quarter-wavelength helical and rod antennas are operated as a single half-wavelength antenna. Since the radiating power distribution is large at the middle portion of the antenna however, the effective length and the gain of the antenna are reduced due to interference from the user's body. Also, since the helical antenna is positioned on a top portion of the antenna housing, it has little aesthetic appeal. Furthermore, such a set-up places the center of gravity of the radio set awkwardly high, so that the antenna swings and rotting noise begins, thus reducing the antenna's efficiency.

When the antenna is retracted, the stopper is connected to the second feeder, which in turn, is connected to the circuit board. Hence, the impedance of the rod antenna becomes infinite and therefore radiates no power. In this position, the helical antenna is connected to the first feeder and the helical antenna radiates power. Since a portion of the total radiating power is distributed to the retracted portion of the rod antenna however, actual radiating power is reduced.

Another notable effort in antenna development is disclosed in U.S. Pat. No. 5,204,687 entitled *Electrical Device and Electrical Transmitter-Receiver particularly useful in a CT2 Cordless Telephone* issued to Elliott et al. The device includes a quarter wavelength rod antenna carried by a housing, and a quarter wavelength antenna coil carried by one end of the antenna rod. The antenna rod is movably mounted through an opening in its housing to a retracted position wherein only the antenna coil is disposed externally of the housing, or to an extended position wherein the complete antenna rod and the antenna coil are disposed externally of the housing. In the retracted position however, only the antenna coil is operating, while in the extended position, only the antenna rod is operating. I have found therefore, the antenna is unable to continually maintain the characteristics of a rod antenna in both the retracted and extended positions.

U.S. Pat. No. 5,245,350 entitled *Retractable Antenna Assembly with Retraction Inactivation* issued to Sroka discloses another type of antenna assembly including an elongated radiating element which is movable between a retracted position and an extended position. The elongated element includes a central conductor which may be a solid rod antenna or, alternatively, may be in the form of a close-wound coil. It has been my observation however, that such an antenna assembly does not enjoy the versatility of being effectively operable as both a rod antenna and a helical antenna.

U.S. Pat. No. 5,258,772 entitled *Antenna Device* issued to Inanaga et al. mentions an antenna assembly including a retractable main antenna with a conducting coil spring connected to a base of the main antenna. When the main antenna is retracted into a housing, the coil spring is contracted and serves as a short antenna coil. It is my opinion however, that the gain of the antenna is reduced due to interference from the user's body because the coil spring is positioned within an interior portion of the housing.

SUMMARY OF THE INVENTION

Accordingly, it is an object of the present invention to provide an improved radio antenna and process for radiating power.

It is another object to provide a radio antenna having radiating power centralized at a top portion of a rod antenna.

It is yet another object to provide a radio antenna and process for preventing periodic reductions in radiating power.

It is still another object to provide a radio antenna and process for maintaining the characteristics of a rod antenna, even though the rod antenna is disposed within and extends through a helical antenna.

These and other objects may be achieved according to the principles of the present invention with an extendable and retractable antenna installed on a body of a housing of a portable radio set. The antenna may be constructed with a helical antenna having an antenna cap protruding from a top portion of the body housing and a helical winding disposed within the antenna cap, a rod antenna also disposed within the antenna cap, and a feeder positioned at a bottom portion of the helical antenna. The helical antenna is operated when the antenna is retracted. The rod antenna is insulated from the helical antenna when retracted, and passes through the helical antenna to protrude from the body housing when extended. The feeder operates the rod antenna when the rod antenna is extended and operates the helical antenna when the rod antenna is retracted.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1A:
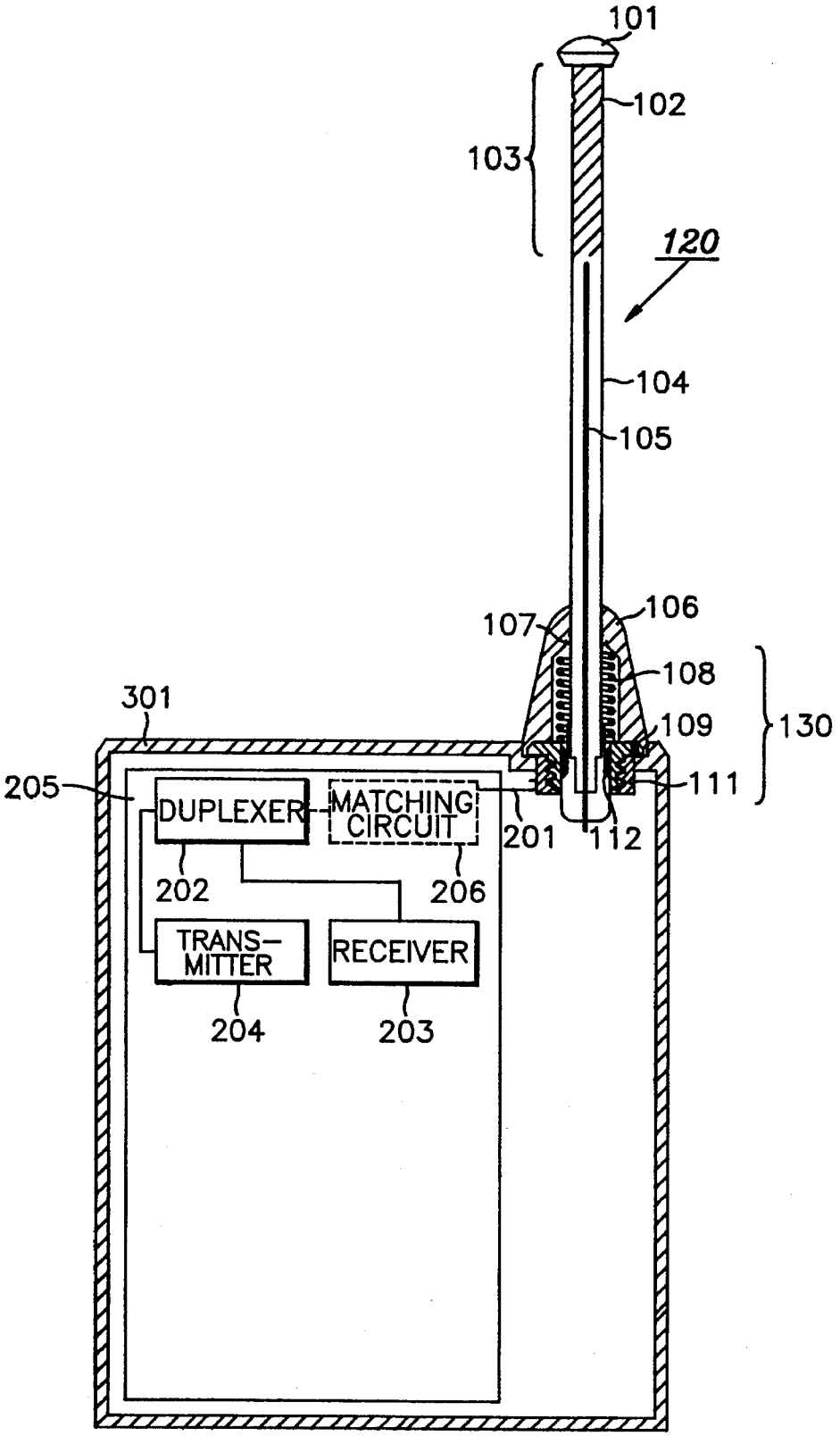
FIG. 1A is a cross-sectional view of an extended portable radio antenna constructed according to the principles of the present invention.
Figure 1B:
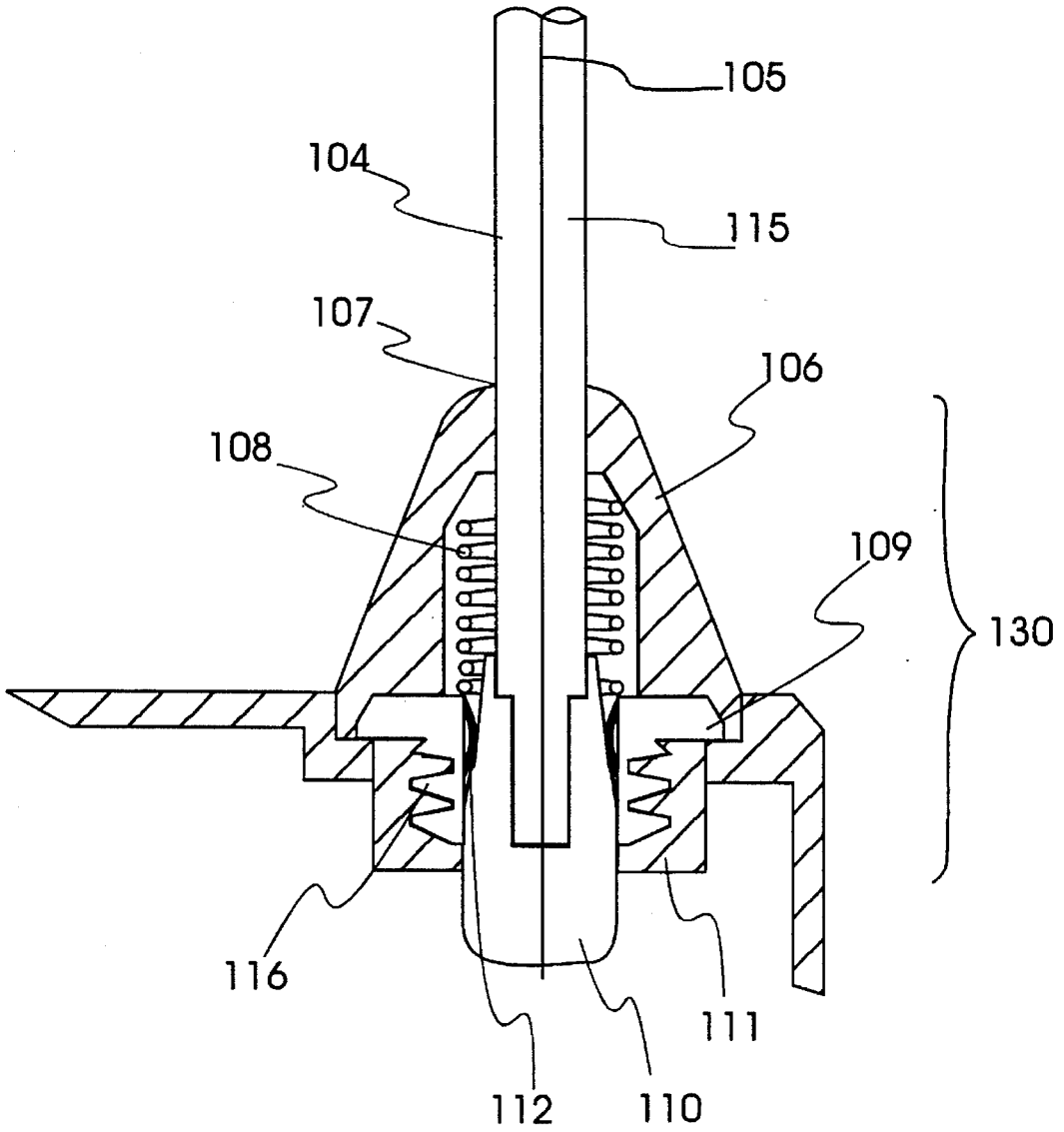
FIG. 1B is an enlarged cross-section view showing details of the construction of the antenna in FIG. 1A.
Figure 2:
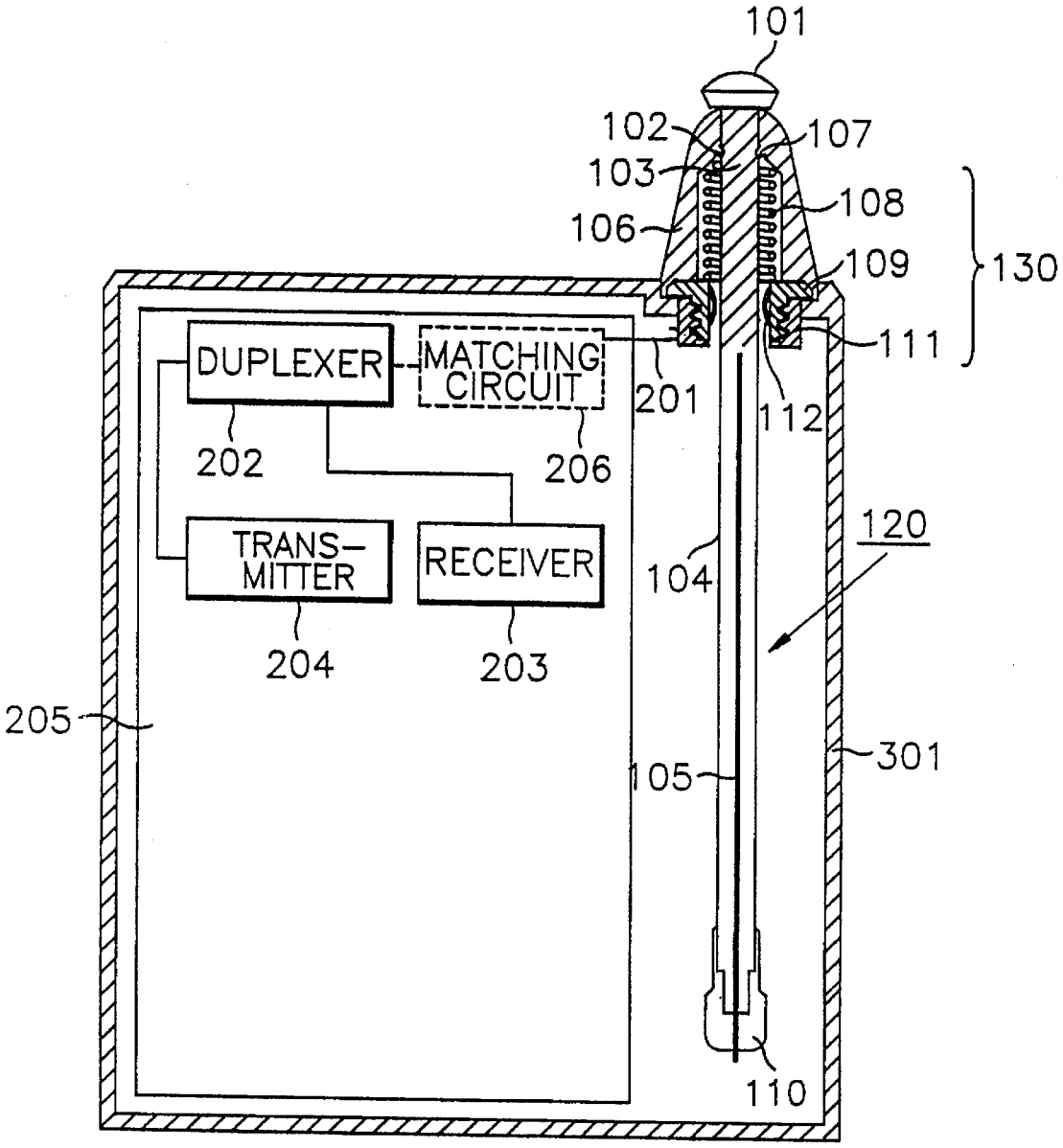
FIG. 2 is a cross-sectional view of a retracted portable radio antenna constructed according to the principles of the present invention.
Figure 3:
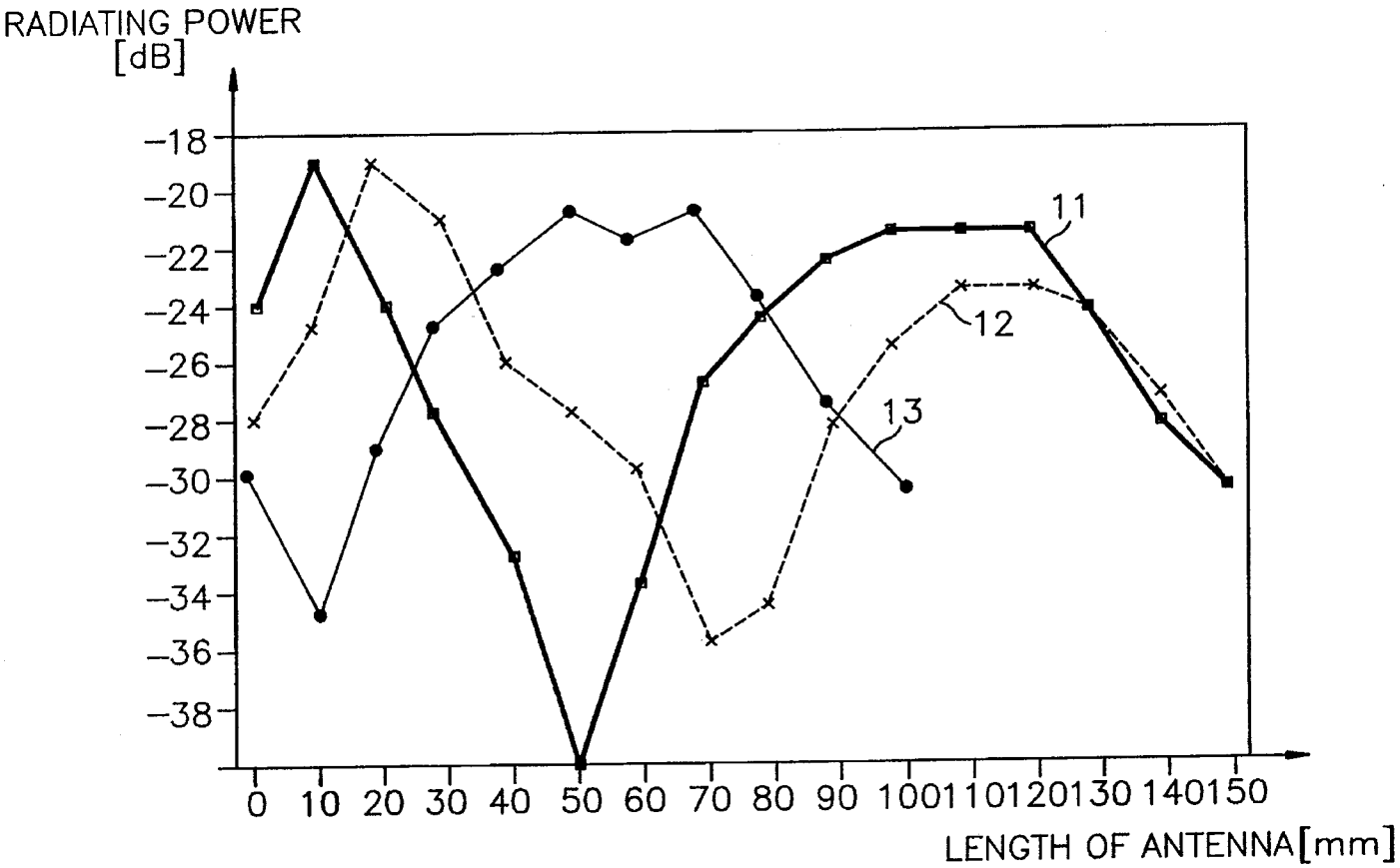
FIG. 3 is a chart showing a representative relationship between radiating power and antenna length, for an antenna constructed according to the principles of the present invention.

Turning now to the drawings and referring to FIGS. 1A, 1B and 2, a helical antenna 130 and a rod antenna 120 are fixedly attached to a top portion of the body of a housing 301 by an antenna cap 106. On an upper interior of the antenna cap 106, a lug 107 is formed for inserting rod antenna 120, and a conductive ring 111 with a female screw is fixedly installed within a recess formed a top surface of the body housing 301. A housing connector 109 having a cylindrical opening 115 and a male screw 116 formed on its outer periphery is also installed within the recess in body housing 301 and coaxially attaches with the conductive ring 111. A bottom portion of a helical winding 108 is fixedly attached to an upper surface of housing connector 109. The helical winding 108 is installed within antenna cap 106. The upper surface of housing connector 109 is fixed to a bottom portion of antenna cap 106 and is substantially fluid with a top surface g body housing 301.

It is preferable that rod antenna 120 be constructed from a hollow, cylindrical rod 104 made of polyacetal. Polyacetal is a strong, stiff, thermoplastic material with a low coefficient of friction and a high resistance to abrasion. The polyacetal rod 104 extends through the antenna cap 106 and has an antenna insertion hole formed within its interior. An insulator 103 is positioned on an upper portion of polyacetal rod 104 and a fixed flute 102 is formed on an upper portion of the insulator. A knob 101 is formed at a top end of polyacetal rod 104. The polyacetal rod 104 is insertable within cylindrical opening of housing connector 109 and extends through a middle portion of helical winding 108. A stopper 110 is provided an a bottom end of the polyacetal rod 104 to prevent the rod from being fully removed from the cylindrical opening of the housing connector 109 during extension. A rod antenna core wire 105 having a bottom portion fixed to the stopper 110 is positioned within the hollow interior of polyacetal rod 104.

When rod antenna 120 is retracted, lug 107 formed on the upper interior of antenna cap 106 is inserted within fixed flute 102. When rod antenna 120 is extended, stopper 110 fixed to bottom end of polyacetal rod 104 is fixed by a plate spring 112 biased inwardly to form an electrical contact with bottom end. Plate spring 112 is composed of an electrically conductive elastic material and is positioned on an inner periphery of the cylindrical opening of housing connector 109. Conductive ring 111 and a printed board 205 are electrically connected by a feeding connector 201. A transmitter 204 and a receiver 203 respectively transmit and receive given radio signals. A duplexer 202 couples transmitter 204 and receiver 203 to feeding connector 201. If there is any necessity for impedance matching between duplexer 202 and the antenna, a matching circuit 206 may be connected between the duplexer 202 and the feeding connector 201. Transmitter 204, receiver 203 and duplexer 202 are positioned on printed board 205 and installed within the body of housing 301.

Figure 4A:
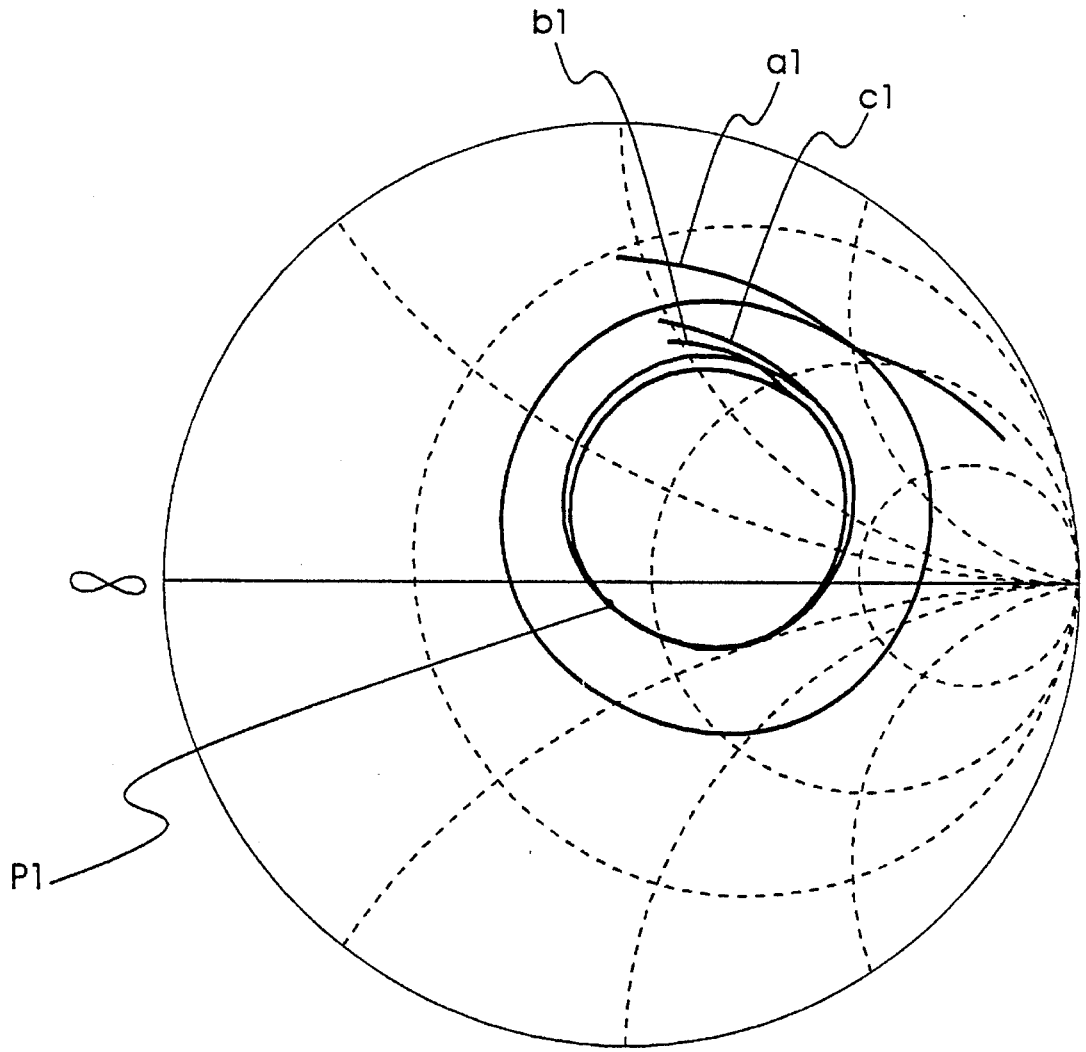
FIG. 4A is a Smith Chart illustrating the transmission impedances of an antenna constructed according to the principles of the present invention.
Figure 4B:
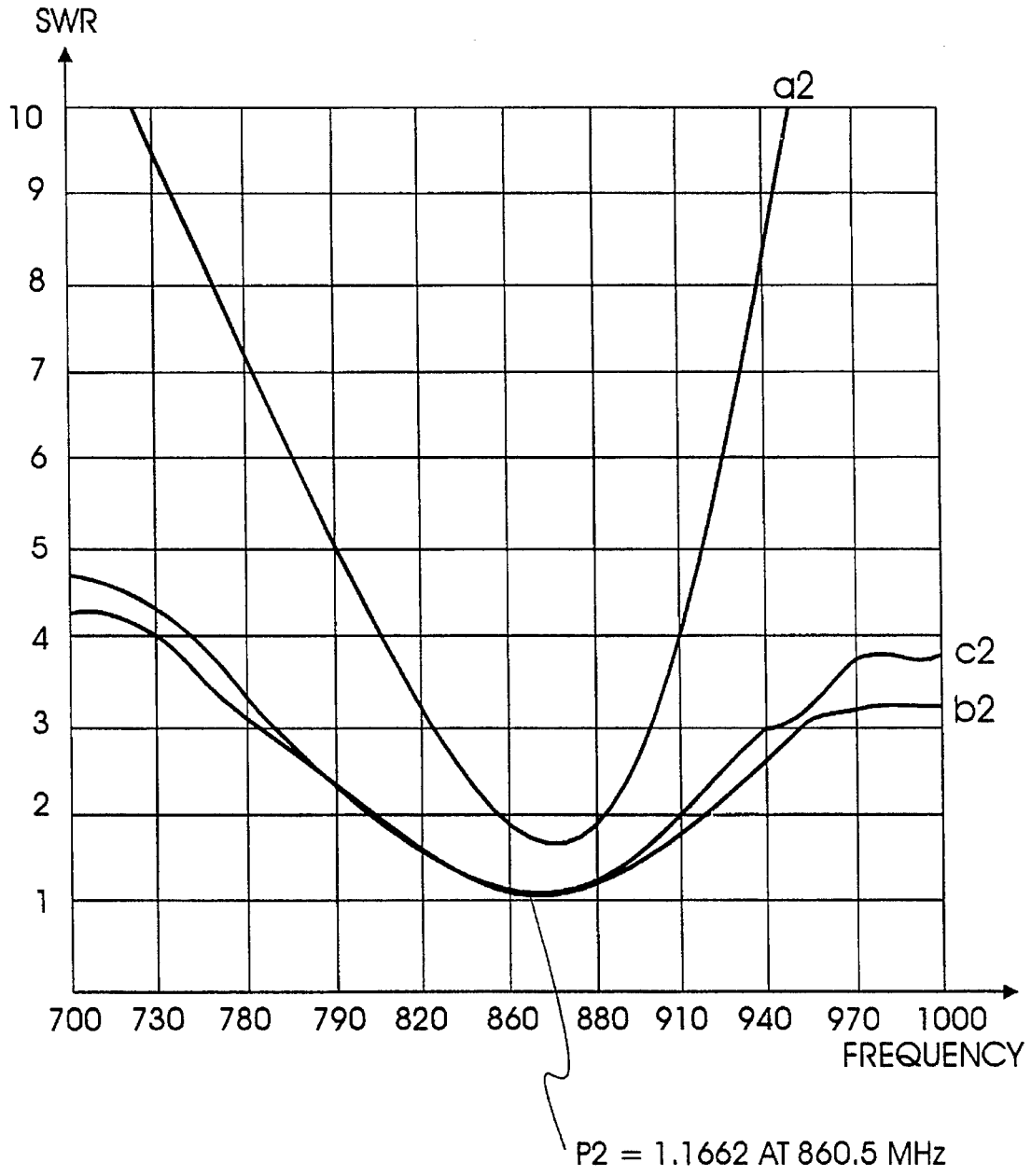
FIG. 4B is a graph illustrating the Standing Wave Ratios of an antenna constructed according to the principles of the present invention.
Figure 4C:
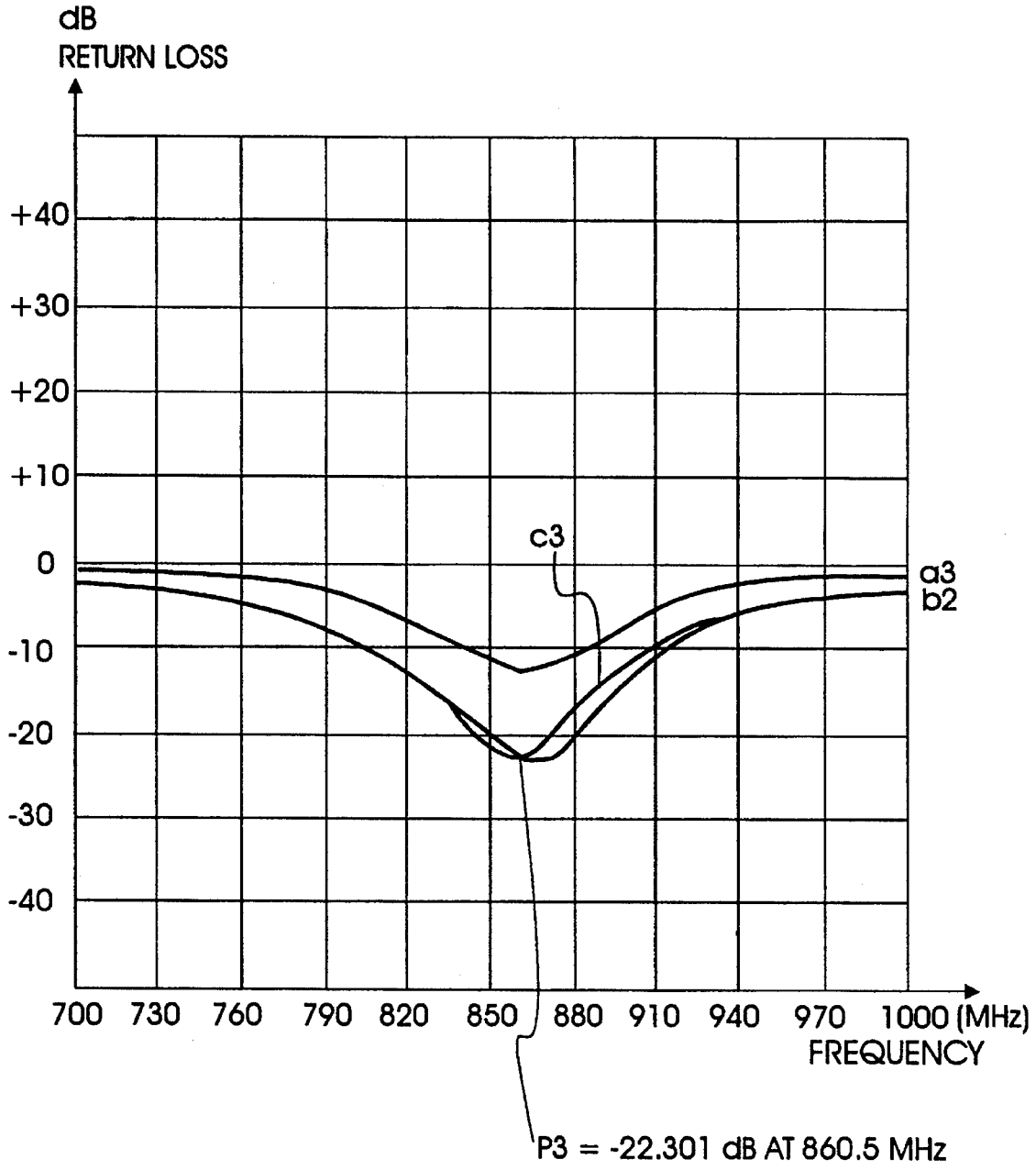
FIG. 4C is a graph illustrating the return losses of an antenna constructed according to the principles of the present invention.

FIGS. 4A, 4B and 4C show impedance matching states for an antenna constructed according to the principles of the present invention. FIG. 4A shows a Smith chart having transmission impedance data, FIG. 4B shows the standing-wave ratio (from 0 to 10) versus frequency, and FIG. 4C shows the return loss (from −40 to +40 dB) versus frequency. Reference symbols a1, a2, and a3 designate the Smith chart, standing-wave ratio, and return loss, respectively, in the case that the antenna is operated with the helical antenna 130 (that is, while rod antenna 120 is in its retracted position). Symbols b1, b2, and b3 designate the aforementioned in the case that the antenna is operated, in combination, with both the helical antenna 130 and the rod antenna 120 (that is, while rod antenna is in its extended position). Symbols c1, c2, and c3 designate the aforementioned, showing the characteristics of the rod antenna 120.

As seen from FIGS. 4A through 4C, the characteristics of the antenna when operated in combination, as both a rod antenna and a helical antenna (b1–b3) and its characteristics when operated as only a rod antenna (c1–c3), are virtually identical. FIG. 4A shows both the combination antenna (b1) and the rod antenna (cl) to have a transmission impedance of 45.77–j6.033 ohms at 860.5 MHz (see point p1). FIG. 4B shows Standing-Wave Ratios of both the combination antenna (b1) and the rod antenna (c1) (i.e. the ratio of maximum voltage to minimum voltage along the transmission line) to also be the same, both having a SWR of 1.1662 at 860.5 MHz (see point p2). The helical antenna (a2) has a slightly higher SWR of approximately 1.4 at the same frequency.

FIG. 4C shows the combination antenna (b3) and the rod antenna (c3) to have a nearly identical return loss of −22.301 dB at 860.5 MHz (see point p3). The return loss for the helical antenna (a3) is approximately −14 dB at the same frequency. Therefore, it is clearly seen that the antenna of the present invention advantageously maintains the characteristics of a rod antenna even when disposed within and extending through a helical antenna (that is, even the helical antenna is co-axially positioned around, but spaced-apart from the rod antenna).

The preferred embodiment constructed according to the principles of the present invention will now be described in detail with reference to FIGS. 1A through 4C. In this preferred embodiment, the antenna system embodying the present invention is used in a portable radio set for transmitting and receiving radio frequency signals having frequencies between exemplary bandwidths of 824–849 MHz and 869–894 MHz.

As shown in FIGS. 1A and 2, rod antenna 120 includes a top portion with knob 101, fixed flute 102, and insulator 103 and a bottom portion with stopper 110. The antenna core wire 105 extends from stopper 110 to a bottom portion of insulator 103. Rod antenna 120 is surrounded by polyacetal rod 104 and has good restoring force. That is, when rod antenna 120 is extended and lateral force is thereto applied, the rod has a strong tendency to restore itself back to the equilibrium position from which it was displaced. Antenna core wire 105 is preferably comprised of silver plated copper wire, piano wire, super elastic nickel-titanium wire having good original shape restoring force, or the like. The electrical length of antenna core wire 105 depends upon the vertical length of the body of housing 301, and thus varies from a quarter-wavelength to a half-wavelength (about 87 to 174 mm at 860 MHz). In one preferred embodiment, the physical length of antenna core wire 105 is 132 mm, but becomes shorter due to the permitivity of the polyacetal rod 104. If the length of the body of housing 301 is short, extendable telescoping type antennas may be used.

Helical winding 108 of the helical antenna 130 is comprised of silver-plated piano wire having an outside diameter of 5.6 mm and 9 turns. Since helical antenna 130 is comprised of helical winding 108, its physical length is considerably shorter than that of rod antenna 120. Specifically, the helical antenna has a physical length of 18 mm which extends to 159 mm if the helical coil is unwound. Therefore, the actual physical length of the unwound helical antenna is longer than that of the antenna core wire (105), but shorter than that of the rod antenna (120).

When rod antenna 120 is retracted into the body housing 301, since the housing connector 109 positioned at the bottom portion of the helical winding 108 is connected to the conductive ring 111 and the conductive ring 111 is connected to feeding connector 201 fixed to the printed board 205, a radio frequency signal passing through the helical antenna 130 is impedance-matched through matching circuit 206. Also when retracted, rod antenna 120 is separated from housing connector 109, and the radio frequency signal is detected only by helical antenna 130 protruding from the body of housing 301. The length of insulator 103 positioned on the upper portion of rod antenna 120 is equal to or greater than that of helical antenna 130, thereby eliminating mutual interference between rod antenna 120 and helical antenna 130. Therefore, when rod antenna 120 is retracted, the radio frequency signal radiates through only helical antenna 130 and the electrical characteristics are as indicated by a1, a2, and a3 in FIGS. 4A, 4B and 4C.

If rod antenna 120 is extended, rod antenna 120 passes through the interior of helical antenna 130 and extends from the body of housing 301. Stopper 110, constructed from a material such as nickel-plated phosphor bronze having good forming and mechanical characteristics, is connected to plate spring 112, which is constructed from beryllium bronze and exhibits good elasticity. When extended, since the housing connector 109 positioned at the bottom portion of the helical winding 108 is electrically connected to the conductive ring 111, and the conductive ring 111 is electrically connected to feeding connector 201 fixed to printed board 205, the radio frequency signal passing through rod antenna 120 is impedance-matched through matching circuit 206. Also, since the rod antenna 120 passes closely through helical antenna 130, a very strong electrical coupling effect is generated between the two antennas.

When operated in this manner, helical antenna 130 exhibits, via rod antenna 120, electrical characteristics which are indicated by b1, b2, and b3 of FIGS. 4A, 4B and 4C. Due to the strong coupling effect, these characteristics are nearly identical to those produced when only rod antenna 120 is operated, as is shown by c1, c2, and c3 of FIGS. 4A, 4B and 4C. In addition to showing the aforementioned electrical and operational characteristics of rod antenna 120, when rod antenna 120 is extended, the radiating power distribution is as indicated by the bold line 11 of FIG. 3. Broken line 12 and solid line 13, respectively indicate the radiation power distribution for the conventional antenna discussed in the background and the improved antenna. In the present invention, a large amount of radiating power is distributed to the top end of the rod antenna 120. In contrast, a portable radio telephone with a conventional antenna has the centralized radiating power distributed to the bottom or middle portions of the rod antenna 120. Since the bottom and middle portions of the rod antenna 120 are close to a user's head, a reduced radiating power results. However, in a portable radio antenna constructed according to the principles of the present invention, since the largest amount of radiating power is distributed at the upper portion of the rod antenna 120, the adverse interference generated by the user's body is minimized. Accordingly, the loss of radiating power is reduced and speech sensitivity is improved.

While preferred embodiments of the present invention have been specifically shown and described, it will be understood by those skilled in the art that changes in form and details may be made without departing from the spirit and scope of the present invention.

What is claimed is:

1. An antenna comprising:

a body housing;

helical antenna means installed on a top surface of said body housing and rod antenna means installed to extend from and retract into said body housing;

said helical antenna means having an antenna cap protruding from said top surface of said body housing and a helical winding disposed within said antenna cap, said helical antenna means being operated when said rod antenna means is in a fully retracted position;

said rod antenna means comprising an antenna core wire, and a protective rod disposed within said antenna cap and passing through said helical antenna means, said protective rod having said antenna core wire positioned within an interior portion and insulating means positioned at a top portion for electrically insulating said rod antenna means from said helical antenna means when said rod antenna means is in said fully retracted position, said antenna having radiating power centralized at a top portion when said rod antenna means is in a fully extended position; and feeding means disposed at a bottom portion of said helical antenna means, said feeding means enabling operation of said rod antenna means when said rod antenna means is in said fully extended position, and enabling operation of said helical antenna means when said rod antenna means is in said fully retracted position, said feeding means comprising:

a conductive ring for providing an electrical connection between said antenna and a printed board, said conductive ring being fully contained within a recess formed in said top surface of said body housing and having a first fastening member formed on an inner periphery; and housing connection means having a top surface with a cylindrical opening and a second fastening member formed on an outer periphery to engage said first fastening member, said housing connection means being positioned within said recess formed in said top surface of said body housing with said top surface of said housing connection means substantially flush with said top surface of said body housing, said housing connection means being electrically connected directly to said conductive ring.

2. The antenna of claim 1, wherein said rod antenna means further comprises:

a knob positioned at a top end of said rod antenna means;

said insulating means having a predetermined length and extending downwardly from said knob; and said antenna core wire extending downwardly from a bottom portion of said insulation means and having a lowermost portion fixed to a stopper positioned at a bottom end of said s rod antenna means, said stopper electrically connecting said antenna core wire to said housing connection means via a plate spring when said rod antenna means is in said fully extended position.

3. The antenna of claim 2, further comprised of said antenna cap completely covering said feeding means to prevent said feeding means from being contacted from an exterior of said body housing.

4. The antenna as claimed in claim 2, wherein said predetermined length of said insulating means is longer than a length of said helical antenna means.

5. The antenna of claim 1, wherein said protective rod comprises a polyacetal rod.

6. The antenna of claim 3, wherein said protective rod comprises a polyacetal rod.

7. The antenna of claim 2, further comprised of said antenna core wire comprising a material selected from a group comprised of silver plated copper wire and super elastic nickel-titanium wire.

8. The antenna of claim 2, wherein said stopper is electrically connected directly to said plate spring when said rod antenna means is in said fully extended position.

9. The antenna of claim 2, wherein said feeding means further comprises:

a feeding connector for electrically connecting said conductive ring with said printed board.

10. An antenna installed on a body housing of a portable radio apparatus, said antenna comprising:

an antenna cap;

rod antenna means for extending and retracting through said antenna cap;

helical antenna means positioned within said antenna cap on a top surface of said body housing;

feeding means positioned wholly within a recess formed in said top surface of said body housing and providing a direct electrical connection between said rod antenna means and a printed board and between said helical antenna means and said printed board, said feeding means being completely covered by said antenna cap to prevent said feeding means from being contacted from an exterior of said body housing;

said rod antenna means comprising insulating means extending over a designated portion of a polyacetal rod, said polyacetal rod having an antenna inserting hole formed within an interior portion;

said polyacetal rod extending through said antenna cap and a middle portion of said helical antenna means; and an antenna core wire having a bottom portion fixed to a stopper, said antenna core wire being positioned within said interior portion of said polyacetal rod.

11. The antenna of claim 10, wherein said insulating means insulates said helical antenna means so that said helical antenna means can be operated without electrical interference from said rod antenna means when said rod antenna means is in a fully retracted position.

12. The antenna of claim 10, wherein said polyacetal rod is fixed to a cylindrical opening of said feeding means by said stopper when said rod antenna means is in a fully extended position.

13. The antenna of claim 10, wherein said feeding means comprises:

a conductive ring fixedly installed within said recess formed in said top surface of said body housing;

housing connection means having a top surface and a cylindrical opening, said housing connection means being fixedly and concentrically installed within and electrically connected directly to said conductive ring so that said top surface of said housing connection means is substantially flush with said top surface of said body housing;

a conductive elastic material installed on an inner periphery of said cylindrical opening of said housing connection means for electrically connecting said housing connection means to said rod antenna means when said rod antenna means is in a fully extended position; and a feeding connector for electrically connecting said conductive ring to said printed board.

14. The antenna as claimed in claim 13, wherein said conductive elastic material comprises a plate spring.

15. A portable radio comprising:

an antenna apparatus;

transmitter and receiver means for transmitting and receiving a radio frequency signal to and from said antenna apparatus, respectively;

connecting means having first and second conductive ends;

duplexing means for coupling said transmitter and receiver means to the first end of said connecting means;

housing means provided with a recess formed within a top surface, said housing means enclosing said transmitter and receiver means, said duplexing means and said connecting means;

a conductive ring electrically connected directly to said second end of said connecting means for providing transmission of said radio frequency signal between said antenna apparatus and said transmitter and receiver means, said conductive ring being fully contained within said recess of said housing means and having a first fastening member formed on an inner periphery;

housing connection means having a top surface with a cylindrical opening and a second fastening member formed on an outer periphery to engage said first fastening member, said housing connection means being positioned within said recess of said housing means with said top surface of said housing connection means substantially flush with said top surface of said housing means: said housing connection means being electrically connected directly to said conductive ring; and said antenna apparatus comprising:

helical antenna means having a helical winding with first and second ends, said helical antenna means being positioned on said top surface of said housing connection means with said first end of said helical winding being electrically coupled to said housing connection means; and radiating means for extending from and retracting into said housing means said radiating means comprised of a polyacetal rod having a conductive wire positioned within an interior portion and insulating means positioned at a top portion for electrically insulating said radiating means from said helical antenna means when said radiating means is in a fully retracted position, said conductive wire being capacitively coupled to said helical antenna means when said radiating means is in a fully extended position, said antenna apparatus having radiating power centralized at a top portion when said radiating means is in said fully extended position.

16. The antenna of claim 10, further comprised of said antenna core wire comprising a material selected from a group comprised of silver plated copper wire and super elastic nickel-titanium wire.

17. The radio of claim 15, further comprised of an antenna cap positioned over said recess formed in said top surface of said housing means for completely covering said conductive ring and said housing connection means to prevent said conductive ring and said housing connection means from being contacted from an exterior of said housing means.

18. The radio of claim 17, wherein a length of said insulating means is longer than a physical length of said helical antenna means.

19. The radio of claim 15, further comprised of said helical winding of said helical antenna means having an outside diameter in millimeters equal to 0.6 times a number of turns of said helical winding.

20. The antenna of claim 15, further comprised of said conductive wire comprising a material selected from a group comprised of silver plated copper wire and super elastic nickel-titanium wire.

21. An antenna configuration, comprising:

housing means for encapsulating a printed board comprising a transmitter, receiver and duplexer, said housing means provided with a recess on a top surface;

helical antenna means having an antenna cap positioned over said recess on said top surface of said housing means, said helical antenna means comprised of an electrically conductive helical winding disposed within said antenna cap;

rod antenna means comprised of an antenna core wire and a polyacetal rod that extends from and retracts into said housing means, said polyacetal rod having an antenna insertion hole formed within an interior portion to accommodate said antenna core wire and insulating means positioned at a top portion for electrically insulating said rod antenna means from said helical antenna means when said polyacetal rod is in a fully retracted position, said antenna configuration having radiating power centralized at a top portion of said rod antenna means when said polyacetal rod is in a fully extended position;

stopper means connected to a bottom portion of said polyacetal rod for preventing complete withdrawal of said rod antenna means from said housing means;

a conductive ring electrically connected to said printed board for providing transmission of electrical signals between said helical and rod antenna means and said printed board, said conductive ring having a first fastening member formed on an inner periphery and being fully contained within said recess of said housing means; and housing connection means having a top surface with a cylindrical opening and a second fastening member formed on an outer periphery to engage said first fastening member, said housing connection means being positioned within said recess of said housing means with said top surface of said housing connection means substantially flush with said top surface or, said housing means, said housing connection means being electrically connected directly to said conductive ring.

* * * * *

UNITED STATES PATENT AND TRADEMARK OFFICE

CERTIFICATE OF CORRECTION

PATENT NO. 5,479,178
DATED 26 December 1995
INVENTOR(S) Dong-In Ha

It is certified that error appears in the above-indentified patent and that said Letters Patent is hereby corrected as shown below:

IN THE TITLE PAGE

Insert, --Foreign Application Priority Data

May 21, 1993 [KR] Rep. Of Korea . . . . . 8786/1993--

Column 3

Line 58, after "formed", insert --in--;

Line 67, after "substantially", change "fluid" to --flush--;

Column 4

Line 1, after "surface", change "g" to --of--;

UNITED STATES PATENT AND TRADEMARK OFFICE

CERTIFICATE OF CORRECTION

PATENT NO. : 5,479,178
DATED : 26 December 1995
INVENTOR(S) : Dong-In Ha

It is certified that error appears in the above-indentified patent and that said Letters Patent is hereby corrected as shown below:

Column 7, claim 2

Line 37, preceding "rod", delete "s";

Column 9, claim 15

Line 24, after "means" (the first occurrence), insert *comma* -- , --;

Column 10, claim 21

Line 46, after "surface", delete "or , " then

Insert --of--:

Signed and Sealed this

Ninth Day of April, 1996

*Attest:*

*Attesting Officer*

BRUCE LEHMAN

*Commissioner of Patents and Trademarks*